US005911383A

United States Patent [19]

Jacobsen et al.

[11] Patent Number: 5,911,383

[45] Date of Patent: Jun. 15, 1999

[54] TAPE WINDER

[75] Inventors: Chris J. Jacobsen, 153 Country Club Rd., Suite 5, Incline Village, Nev. 89451; Bruce Winkler, Madison, Wis.

[73] Assignee: Chris J. Jacobsen, Incline Village, Nev.

[21] Appl. No.: 09/075,581

[22] Filed: May 11, 1998

Related U.S. Application Data

[60] Provisional application No. 60/046,353, May 13, 1997.

[51] Int. Cl.[6] ..... B65H 16/00

[52] U.S. Cl. ..... 242/420; 242/538; 281/7; 40/437

[58] Field of Search ..... 242/118.5, 420, 242/420.4, 538, 538.1, 538.2, 540; 281/7, 8; 40/347, 518

[56] References Cited

U.S. PATENT DOCUMENTS

| | | | |
|---|---|---|---|
| 778,092 | 12/1904 | Willson | 40/518 |
| 1,388,769 | 8/1921 | Scully | 281/7 |
| 2,403,197 | 7/1946 | Schaller . | |
| 2,965,323 | 12/1960 | Foster | 242/538 |
| 3,017,132 | 1/1962 | Gnage et al. | 242/118.5 |
| 3,106,324 | 10/1963 | Fritzinger | 242/538.1 |
| 3,245,739 | 4/1966 | Clausen | 281/7 |
| 3,383,063 | 5/1968 | Balaban | 242/538 |
| 3,698,658 | 10/1972 | Skei | 242/538 |
| 3,785,729 | 1/1974 | Dasher et al. . | |
| 3,871,597 | 3/1975 | LaMers | 242/420.4 |
| 4,095,359 | 6/1978 | Trame . | |
| 4,116,468 | 9/1978 | Marten | 281/7 |
| 4,277,033 | 7/1981 | Swenson | 40/518 |
| 4,469,287 | 9/1984 | Pfister et al. | 40/437 |
| 4,494,708 | 1/1985 | Stubbs et al. | 400/614 |
| 4,700,906 | 10/1987 | Lapadakis | 400/614 |
| 4,709,869 | 12/1987 | Candler . | |
| 4,753,396 | 6/1988 | Neumann | 40/437 |
| 4,875,634 | 10/1989 | Lapadakis | 242/538.1 |
| 5,374,007 | 12/1994 | Murison | 242/538.2 |
| 5,432,687 | 7/1995 | Lane . | |

FOREIGN PATENT DOCUMENTS

| | | | |
|---|---|---|---|
| 840629 | 7/1960 | United Kingdom | 242/538 |

*Primary Examiner*—John P. Darling
*Attorney, Agent, or Firm*—DeWitt Ross & Stevens S.C.

[57] ABSTRACT

A tape winder including a supply spindle for supplying tape, a take-up spindle for taking up tape from the supply spindle, and opposing sidewalls with slots therein wherein the spindles are rotatably received. A drive mechanism located on the sidewalls engage the spindles when the spindles are fully inserted within the slots. The slots preferably include a narrow throat region near their openings so that the spindles may be snap-fit within the slots. The supply spindle is preferably driven with lesser torque than the take-up spindle so that the difference in relative torque between the spindles maintains tension in the tape and causes it to wind tightly.

17 Claims, 3 Drawing Sheets

TAPE WINDER

CROSS-REFERENCE TO RELATED APPLICATIONS

This application claims priority under 35 USC §119(e) to U.S. Provisional Patent Application 60/046,353 filed on May 13, 1997, the entirety of which is incorporated by reference herein.

FIELD OF THE INVENTION

This invention relates generally to a device for reviewing information printed on a roll of paper tape or other rolled flexible material, and particularly to a reeling device for winding a length of tape from one roll to another so that information printed thereon may be reviewed.

BACKGROUND OF THE INVENTION

It is common practice in retail stores, restaurants, and the like to review cash register tapes in order to monitor the transactions recorded on such tapes. This is usually done by observing the tape as it is manually unwound from the used roll. Alternatively, the prior art illustrates devices such as those shown in U.S. Pat. No. 4,116,468 to Marten, U.S. Pat. No. 4,469,287 to Pfster et al., and U.S. Pat. No. 4,753,396 to Neumann for winding tape from a supply roll to a take-up roll, and allowing review of the tape between these rolls. However, the tape winding devices of the prior art suffer from several disadvantages.

First, the spindles upon which the tape rolls ride tend to be mounted on the tape winders in enclosed fashion, wherein the spindles are journaled within apertures in the sidewalls of the tape winders. This tends to make it difficult to remove the spindles from the sidewalls of the tape winders so that tape can be rapidly and easily loaded and unloaded from the spindles.

Second, the tape winders of the prior art lack means for tensioning the tape as it is being reviewed so that slack does not develop in the tape. If slack develops, the tape can become difficult to read and mark, and it can also cause the tape to become dirtied or ripped if the tape contacts objects outside the tape winder. Most commonly, slack will develop in a tape winder owing to the rotational inertia of the spindles upon which the tape rides. One spindle of a tape winder will almost invariably be carrying a greater amount of tape than the other spindle, and therefore that spindle will have greater inertia. As a result, the heavier spindle will tend to resist cessation of rotation when its motor is deactivated, with the lighter spindle coming to an earlier stop and the heavier spindle continuing to rotate for at least several turns. Where the heavier spindle is the take-up spindle, this is not of great concern because the heavier take-up spindle will simply pull a small length of additional tape from the supply spindle. However, when the heavier spindle is the supply spindle, this tends to cause the supply spindle to eject a length of slack tape. Slack can also develop due to differences in the sizes of the tape rolls borne by each spindle. As an example, a larger diameter tape roll will supply excess tape to a smaller diameter tape roll rotating at the same speed, resulting in slack. Similarly, a smaller diameter tape roll cannot supply sufficient tape to a larger diameter tape roll traveling at the same speed, resulting in tension and possible ripping of the tape.

Third, the tape winders of the prior art also have the problem that they do not accommodate tape rolls having differently sized axial bore diameters, as when a tape is wound about a spindle which is larger or smaller than standard size, or when the tape at the center of the roll is damaged or creased. Quite often, the axial bores at the centers of tape rolls do not have consistent sizes, and therefore the bore of a particular tape roll may be too large to tightly fit over a given spindle or too small to fit over a spindle at all.

There is a need in the art for a tape winder which facilitates review of elongated flexible materials such as cash register tapes; which maintains the tape in a spooled condition after review; which addresses the aforementioned disadvantages of the prior art devices; and which is compact, reliable in operation, and easy and inexpensive to manufacture, operate and repair.

SUMMARY OF THE INVENTION

The invention is directed to a tape winder in accordance with the claims set out at the end of this disclosure. In one preferred embodiment, the tape winder includes a supply spindle and a take-up spindle wherein the take-up spindle takes up tape from the supply spindle. Each spindle is rotatably mounted within a pair of sidewalls, preferably by providing a slot in each sidewall wherein the ends of the spindle axle may be removably inserted. Each slot terminates in a pocket region, and drive means for releasibly engaging and rotatably driving the spindles are located on the sidewalls adjacent each pocket region. Thus, when the ends of the spindle axles are inserted within the slots to rest within the pocket regions, they are rotatably received by the pocket regions, and the spindles are releasibly engaged by the drive means so that they may be rotatably driven to wind tape from the supply reel to the take-up reel and vice versa. The tape winder is easy to use because the spindles may be rapidly inserted and removed from the winder, allowing exceptionally convenient installation and replacement of tapes on the spindles.

In another preferred embodiment, a tape winder is provided in accordance with the tape winder described above, but the slots in the sidewalls include a narrowed throat region adjacent the pocket region. The axles of the spindles are snapfit (or closely fit) through the throat region to rest within the pocket region. The throat region retains the axes of the spindles and prevents them from being disengaged from the drive means or ejected from the slot when the drive means are actuated and/or suddenly accelerated. This throat region can be integrally formed as a detent on the surface of the slot, or it can be provided by a separate structure mounted in association with the sidewalls, e.g., a key which provides lands or protrusions on either or both sides of the slot to form a narrowed throat region adjacent the pocket.

In another preferred embodiment, the tape winder includes tensioning means in association with either or both of the spindles for maintaining tension on the tape during winding, and after the drive means are deactivated. The tensioning means prevent slack from generating and thereby insure that the tape remains protected within the tape winder, and at the same time, they maintain tension at a level such that ripping or fraying of the tape does not result. This may be done by simultaneously driving both spindles and driving the supply spindle with lesser torque than the take-up spindle. The relative difference in torque between the spindles will cause the take-up spindle to maintain tension on the tape. The supply spindle can even be driven with low-magnitude negative torque, i.e., it can be driven in a direction opposite that of the take-up spindle. In this case, the high-magnitude positive torque on the take-up spindle will defeat the negative torque to pull tape from the supply spindle. Alternatively, the tensioning means can be provided by driving the take-up spindle at a greater speed than the supply spindle and providing slip means in association with the supply spindle so that it may slip if undue tension in the tape arises. These slip means can be provided by using a belt drive with properly chosen belt tension as a part of the drive means, or by conventional slip disks (i.e., a frictional clutch) on the spindles.

The tape winders described above are preferably provided with a platform between the spindles whereupon the tape rides. Such a platform allows the tape to be easily reviewed, and marked if desired. The platform preferably bears rollers at its edges so that friction between the tape and the platform is reduced, and so that the tape will not become frayed upon entering and exiting the platform.

The spindles of the tape winders described above preferably include two disks (or similar structures) spaced along the length of the spindles so that the tape is directed onto the spindle between the disks, and so that it does not wind crookedly on the spindles. At least one of the disks is preferably adjustable along the length of the spindle. This may be done by providing a bore in one disk wherein the spindle may be inserted, and providing locking means on the wall of the bore for releasibly engaging the spindle at different points along its length.

The tape winders described above may be provided in kit form in combination with one or more additional spindles having different axial diameters. This allows users to accommodate tape rolls having differently-sized axial bores, and it also allows users to roll particular tapes onto new rolls having differently-sized axial bores. As an example, a user can wind new tapes having standard sizes onto rolls having a larger axial bore, and this larger axial bore can later indicate to the user that the tapes in question have already been reviewed.

Further features and advantages of the invention will be discussed in the Detailed Description of the Invention following the Brief Description of the Drawings.

DETAILED DESCRIPTION OF THE INVENTION

Figure 1:
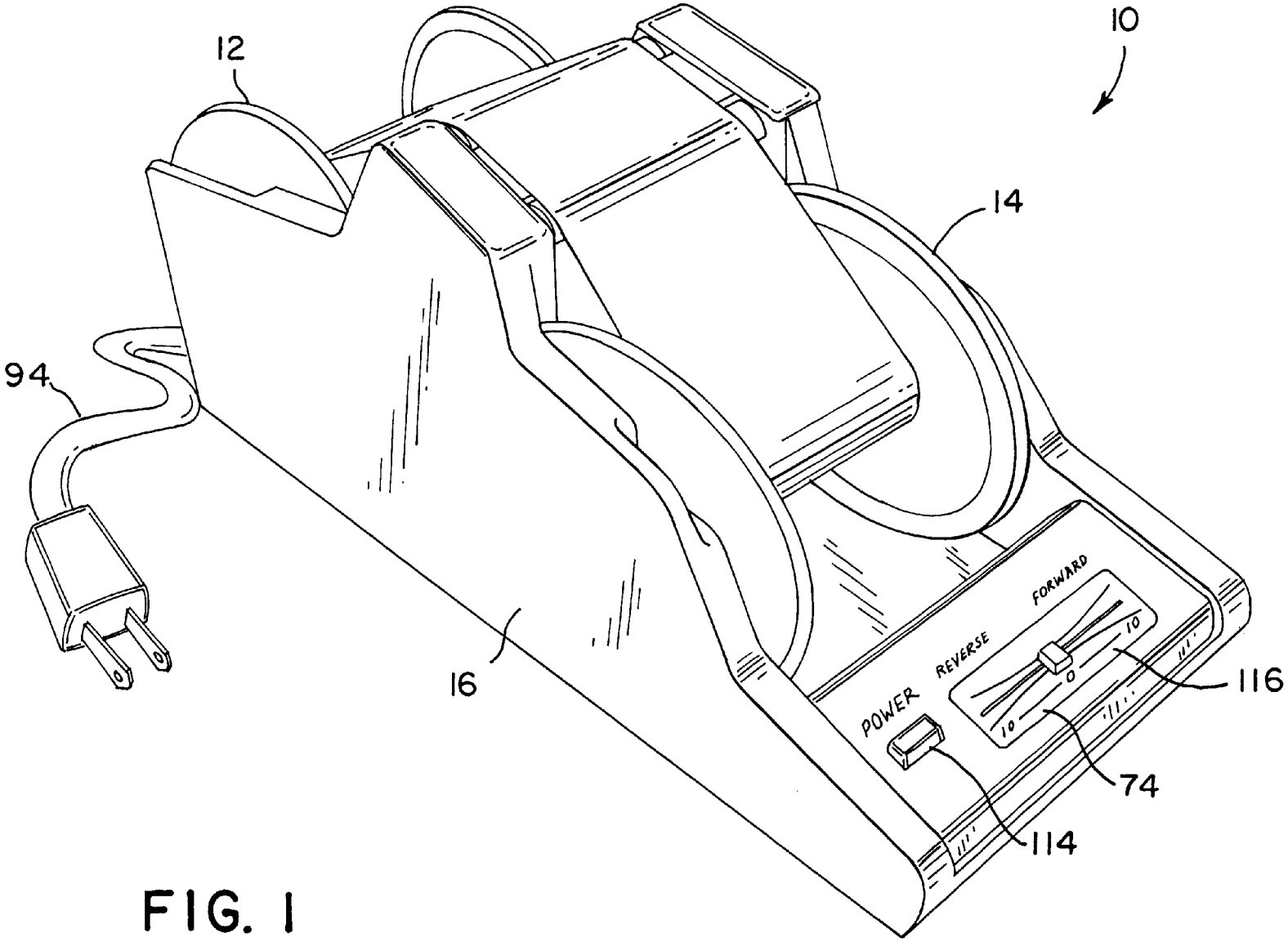
FIG. 1 is a perspective view of one embodiment of a tape winder according to the present invention.
Figure 2:
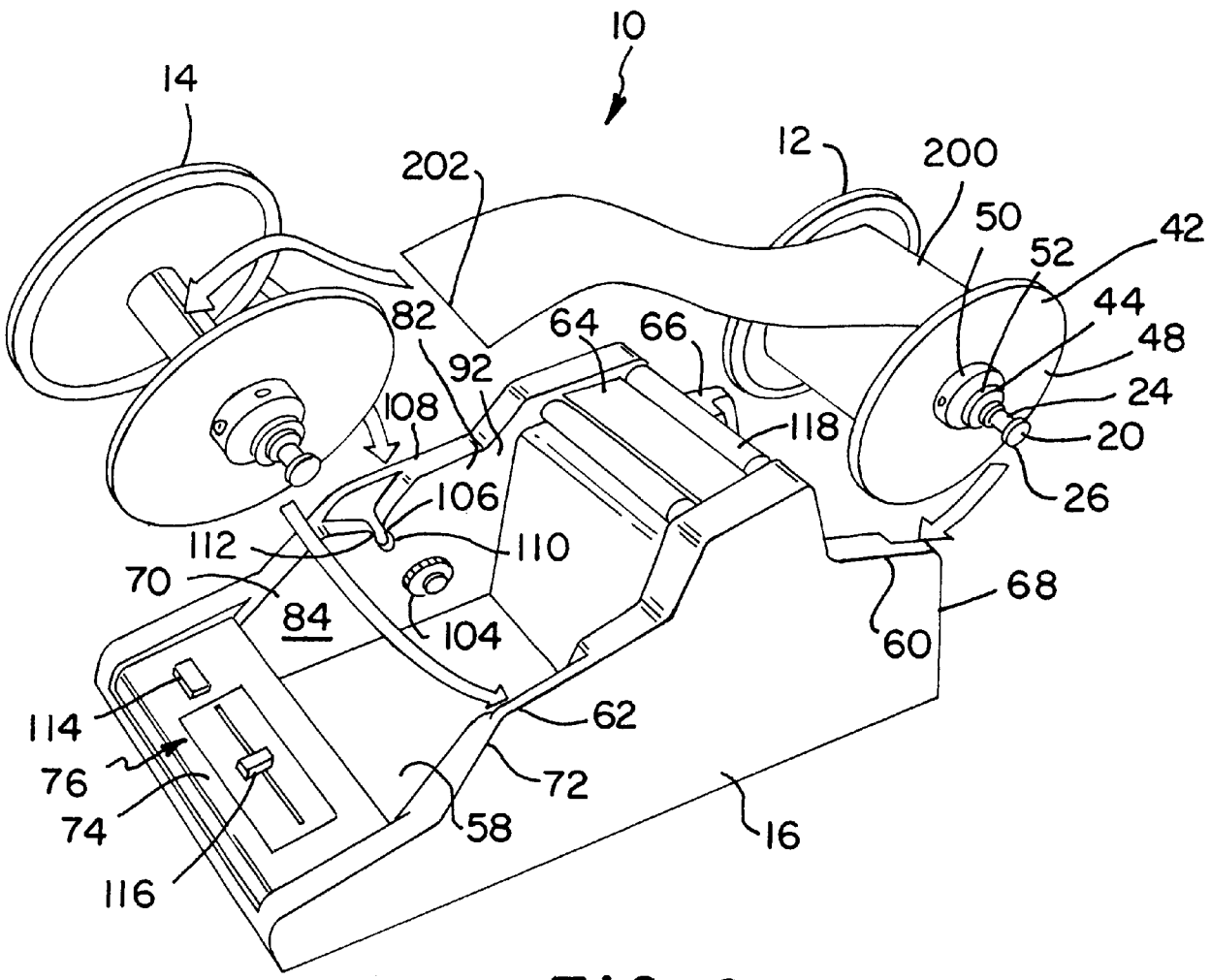
FIG. 2 is a partially exploded perspective view of the tape winder of FIG. 1 illustrating the spindles in relation to the remainder of the tape winder.
Figure 3:
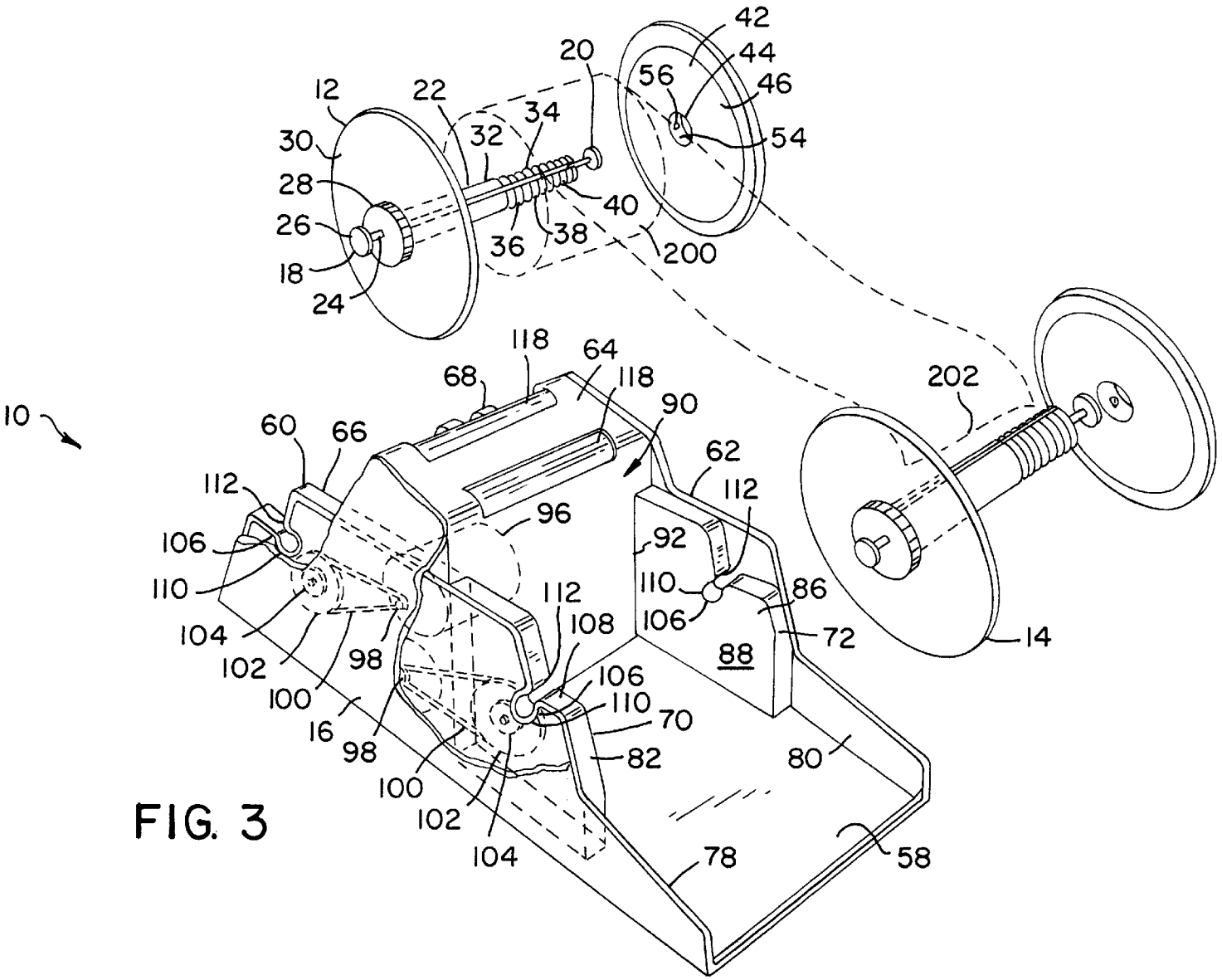
FIG. 3 is a partially exploded perspective view of the tape winder of FIGS. 1 and 2 shown with portions of the tape winder cut away, and with the control portion illustrated in FIGS. 1 and 2 removed.

Referring to the Figures of the Drawings, in which the same or similar features are designated by the same reference numerals, an embodiment of a tape winder in accordance with the present invention is shown in FIGS. 1–3 at the reference numeral 10. As illustrated best by FIGS. 2 and 3, the tape winder 10 includes a first spindle 12, a second spindle 14, and a housing 16. Each of these parts will be discussed in turn below.

The first spindle 12 is best illustrated by FIG. 3, which provides a perspective view of the left side of the first spindle 12 at a first end 18, and FIG. 2, which provides a perspective view of the right side of the first spindle 12 at a second end 20. Referring then to FIG. 3, the first spindle 12 includes a central spindle body 22 bounded on each side by a narrowed valley which defines an axle 24, and a cap 26 which provides an enlarged terminus for the axle 24. The first end 18 of the first spindle 12 additionally includes a gear 28 adjacent the axle 24, and a first disk 30 located between the gear 28 and the spindle body 22. The spindle body 22 includes a smooth portion 32 and a corrugated portion 34 having a series of spaced annular depressions 36 separated by disk-shaped protrusions 38. The spindle body further includes an elongated spindle slot 40 which extends along substantially the entirety of the length of the spindle body 22, and which extends in a generally radial direction throughout the entire diameter of the spindle body 22 so that tape may be inserted into one side of the spindle slot 40 and out the other side.

The first spindle 12 additionally includes a second disk 42 having an axially aligned disk hole 44 therein which is sized to accommodate the second end 20 of the first spindle 12. This disk hole 44 is best shown in FIG. 3, which illustrates an inner side 46 of the second disk 42. As best shown by FIG. 2, which shows an outer side 48 of the second disk 42, the second disk 42 further includes an annular collar 50 having a centrally-located bore 52 coaxially aligned with the disk hole 44 (shown in FIG. 3). Referring to FIG. 3, the bore 52 has an interior bore wall 54 which includes locking means thereon for releasibly grasping the spindle body 22 at various points along the length of the spindle body 22, thereby allowing the second disk 42 to be mounted on the first spindle 12 at varying distances from the first disk 30. In the tape winder 10 illustrated in the Figures, the locking means comprise spring-loaded ball bearings 56 which are retained within the collar 50 and biased in a radially inward direction, but which may be pushed radially outward by a sufficient opposing force. Thus, the second disk 42 may be fit over the second end 20 of the first spindle 12, and may be snapped from one depression 36 to the next by pushing the second disk 42 along the axis of the first spindle 12. Therefore, when a tape roll is fit over the first spindle 12, the second disk 42 may be fit over the second end 20 of the first spindle 12 and adjusted along the axis of the first spindle 12 until the tape roll is closely surrounded by first and second disks 30 and 42. As will be discussed below, this activity is illustrated in FIGS. 2 and 3 with respect to a tape roll 200 loaded over the first spindle 12 and having an end 202 prepared for insertion within the spindle slot of the second spindle 14.

With particular reference to FIG. 3, the second spindle 14 is preferably identical to the first spindle 12 so that the spindles are interchangeable within the tape winder 10. However, the second spindle 14 need not be identical to the first spindle 12. As will be discussed below, various modifications can be made to the first and/or second spindles 12 and 14.

As particularly illustrated by FIG. 3, the housing 16 includes a floor 58, a first pair of sidewalls 60 between which the first spindle 12 is inserted, a second pair of sidewalls 62 between which the second spindle 14 is inserted, and a platform 64 spaced above the floor 58 and located between the first and second sidewall pairs 60 and 62. The first and second sidewall pairs 60 and 62 respectively include sidewalls 66 and 68, and sidewalls 70 and 72. The sidewalls within each sidewall pair 60 and 62 are maintained in spaced relation by the floor 58 of the housing 16. As shown in FIGS. 1 and 2 and as will be discussed below, the housing 16 also includes a front panel 74 having controls 76 thereon. The structures and functions of the various parts of the preferred embodiment of the housing 16 will now be discussed in greater detail.

As best shown in FIG. 3, the floor 58 of the housing 16, which is preferably formed of metal or plastic material, is integrally attached to opposing upwardly-extending walls 78 and 80 which rest adjacent to the sidewalls 66, 68, 70, and 72. The sidewalls 66 and 70, which are preferably formed of plastic material, are preferably integrally formed as a hollow sidewall unit 82 having the inner wall 84 illustrated in FIG. 2. The sidewalls 68 and 72 are similarly preferably integrally formed of plastic material as a hollow sidewall unit 86 having the inner wall 88 illustrated in FIG. 3. The sidewall units may be attached to the floor 58 and/or walls 78 and 80 by any means known to the art suitable for such attachment, e.g., by fasteners, adhesives, or welding processes. The platform 64 is preferably made of plastic or metal sheet material which is formed in a U-shaped configuration so that both of its lateral edges touch the floor 58 with the remainder defining an enclosure 90 within. The longitudinal edges of the platform 64 preferably fit within slots 92 in the inner walls 84 and 88 of the sidewall units 82 and 86 so that the platform 64 may be removably placed and replaced atop the floor 58.

The enclosure 90 formed by the platform 64 may be used to store at least a portion of the drive means for driving the first and second spindles 12 and 14. FIG. 3 illustrates this mechanism in phantom. A power cord 94 (FIG. 1) provides power to actuate drive motors 96, each of which includes a sheave 98 for driving a belt 100. The belts 100 in turn rotate pulleys 102, which are coaxially connected to pinions 104 via connecting rods. As best illustrated by FIG. 2, the sheaves 98, belts 100, and pulleys 102 are preferably located within the interior of the sidewall unit 82 behind its inner wall 84, whereas the pinions 104 are located on the surfaces of the inner wall 84. The inner wall 84 of the sidewall unit 82 serves to rotatably support the rods connecting the pulleys 102 and pinions 104.

As FIG. 3 illustrates, each of the first and second sidewall pairs 60 and 62 include opposing slots 106 which descend from upper surfaces 108 of the sidewalls 66, 68, 70, and 72 to terminate in respective pocket regions 110 adjacent the pinions 104. This allows a user to rapidly and easily insert the first and second spindles 12 and 14 within the first and second sidewall pairs 60 and 62 with the axle 24 fitting within the pocket regions 110, and so that each gear 28 engages the complementary pinion 104 located on the inner wall 84 of sidewalls 66 and 70.

It has been found that if the motors 96 are immediately advanced from zero or very low speed to high speed, the sudden force transmitted from the pinions 104 to the gears 28 may cause each gear 28 to jump upward in its respective pocket region 110 and disengage its respective pinion 104. As a result, the pinions 104 may rotate and "chatter" against the gears 28 without turning the first and second spindles 12 and 14. This problem can be avoided by simply advancing less rapidly to higher speeds, or by providing structure in the slots 106 to prevent the axles 24 from jumping out of the pocket regions 110. For example, as illustrated in FIG. 3, each slot 106 includes a narrowed throat region 112 between the pocket region 110 and the upper surface 108 of each sidewall unit 82 and 86. At this throat region 112, the slot 106 narrows to a diameter which is approximately equal to the diameter of the axle 24. This allows the axles 24 of the first and second spindles 12 and 14 to be inserted within the slots 106 and slipped or snap-fit past the throat regions 112 to rest within the pocket regions 110. The throat regions 112 thereby partially surround the axles 24 and help to prevent the ejection of the axles 24 from the pocket regions 110.

As shown in FIGS. 2 and 3, the housing 16 also includes controls 76 for controlling the action of the first and second spindles 12 and 14. The controls 76 includes an on/off button 114 which provides for connection of power between the power cord 94 (FIG. 1) and a slide switch 116 known to the art. The slide switch 116 can provide increasing amounts of power to the motors 96 as it is pushed greater distances from its open position illustrated in FIG. 1. For example, as the slide switch 116 is pushed to the right, both motors 96 can rotate in the clockwise direction and their speed can be increased as the slide switch 116 is pushed further rightward. Alternatively, if the slide switch 116 is pushed to the left, both motors 96 can rotate in the counterclockwise direction and their speed can be increased as the slide switch 116 is pushed further leftward. A circuit board which includes power conditioning circuitry and/or control circuitry may be included beneath the controls 76, beneath the platform 64, or within or behind the sidewalls 82 and/or 86. If a power supply cord 94 is not included, batteries or other power means known to the art could be located in these spaces instead.

The platform 64 includes two rollers 118, each located at an edge of the platform 64 adjacent one of the sidewall pairs 60 and 62. The portion of the platform 64 located between the rollers 118 is flush with the outer diameter of the rollers 118, or slightly sunken in relation to the outer diameter of the rollers 118. As a result, tape riding across the platform 64 will be carried by the rollers 118, preventing friction of the tape against the platform 64 and possible ripping. The central portion of the platform 64 is preferably smooth so that it allows the user to easily write on or otherwise mark the tape if desired.

A summary of an exemplary mode of operating the tape winder 10 will now be provided. As illustrated in FIGS. 2 and 3, the tape roll 200 is loaded onto the spindle body 22 of the first spindle 12. The second disk 42 is then fit over the second end 20 of the first spindle 12 so that the tape roll 200 is tightly fit between the first and second disks 30 and 42, and so that its locking means (e.g., the bearings 56) engage the spindle body 22. The first spindle 12 is then loaded between the first sidewall pair 60 into the slots 106 so that its axle 24 fits into the pocket regions 110, and so that its gear 28 engages the pinion 104. The end 202 of the tape roll 200 may then be sped by the user and pulled so that a short length of tape is unwound. The end 202 of the tape roll 200 may then be slid into the spindle slot 40 in the second spindle 14, and if desired, the second spindle 14 may be rotated several times to start a take-up roll of tape. The second spindle 14 may then be loaded between the second sidewall pair 62 and fit into the pocket region 110. After such loading, the tape rides over the rollers 118 at the sides of the platform 64. The on/off button 114 may then be engaged, and the slide switch 116 may be actuated to feed tape onto the second spindle 14, or to wind tape back onto the first spindle 12.

Numerous modifications to the tape winder 10 have been contemplated. A brief discussion of several of these modifications follows.

Initially, it is understood that the drive means may be provided in a variety of different forms. As an example, the motors 96 could communicate torque directly to the pinions 104, and in turn to the gears 28 of the spindles 12 and 14. A variety of known power transmission components can be used to transmit torque from the motors 96 to the axles 24 of the first and second spindles 12 and 14, e.g., gearing, belts or chains, pivotally linked bars forming a crank (such as those linking the wheels of a steam locomotive), electromagnetic coupling (e.g., magnetically coupled rotating elements), and other means known to the art. The drive means can be linked to the axles 24 of the spindles 12 and 14 by structure other than the pinions 104, such as by a clutch which engages the first disk 30 or another part of the first and second spindle 12 and 14, or by any other complimentarily-shaped structures which releasibly engage each other. Additionally, either or both of the first and second ends 18 and 20 of the first and second spindles 12 and 14 may be separately or simultaneously linked to drive means located on either or both sidewall units 82 and 86. Further, cranks, wheels, or similar manually-operated drive means could be connected directly to the first and/or second ends 18 or 20 of the first and second spindles 12 and 14 so that the spindles could be manually driven after their insertion into the pocket regions 110. The first disk 30 and/or second disk 42 could themselves function as manually-actuated thumbwheels. Alternatively, manually-operated drive means could indirectly drive the first and second spindles 12 and 14, as by driving the pinions 104 illustrated in FIGS. 2 and 3.

It is understood that the locking means provided on the wall of the bore 52 of the annular collar 50 need not take the form of radially compressible spring-loaded bearings 56. These locking means could instead take the form of any other resilient radially compressible structures, e.g., resilient plastic tabs which may be snap-fit over successive protrusions 38, or an annular spring. Alternatively, the locking means can be replaced with any of the structures illustrated in the prior art for removably mounting disks to spindles.

It is understood that slip means for allowing slippage of the spindles 12 and 14 can be provided in combination with (or as part of) the drive means so that if the tape offers resistance to winding when subjected to tension, the drive means will slip so that the tape does not rip. In the preferred embodiment of the tape winder 10 discussed above, the belts 100 are used to transmit torque between the motors 96 and the pulleys 102/pinions 104 because the tension of the belt 100 may be adjusted so that slippage is provided if binding of the tape roll 200 occurs. Alternatively (or additionally), conventional slip disks (i.e., slip friction clutches) can be provided between the motors 96 and their belts 100, and/or between the pulleys 102 and their pinions 104, to provide for slippage if binding of the tape should occur.

It is understood that the drive means can operate in several different ways to effect different results. A summary of several of the preferred modes of operation of the drive means will now be provided.

First, only one motor 96 need be driven at a time, namely, the motor 96 which drives the take-up spindle. For example, in the embodiment illustrated in FIGS. 2 and 3 wherein a roll of tape is being wound from the first (supply) spindle 12 to the second (take-up) spindle 14, movement of the slide switch 116 to the right can cause the second spindle 14 to rotate in a clockwise direction to wind the tape from the first spindle 12 to the second spindle 14. Similarly, movement of the slide switch to the left can drive the first spindle 12 in the counterclockwise direction to wind tape from the second spindle 14 to the first spindle 12. This mode of operation may be accomplished by using a double-throw switch for switch 116, with each motor 96 connected to one throw. Only the take-up spindle is driven at any given time, and the supply spindle is rotated owing to the tension on the tape.

Second, the drive means can drive each motor simultaneously. For example, the switch 116 can simultaneously connect the leads of each motor 96 to the power source. This is preferably done by supplying the motor of the supply spindle with lesser power than the motor of the take-up spindle, as by interposing resistance between the motor of the supply spindle and the power source. In this case, both motors are driven in the same direction, but the difference in relative torque between the supply and take-up spindles will generally cause the tape to remain taut. In this case, the motor of the supply spindle performs as an active tensioning means for providing tension on the tape between the supply and take-up reels. Alternatively, this can be done by supplying the motor of the supply spindle with a small amount of power with opposite polarity, as by simultaneously connecting opposite leads of the motors and locating resistance at the lead of the supply spindle. This will cause the supply spindle to generate low-magnitude negative torque which winds the tape away from the take-up spindle. However, this negative torque is easily overcome by the higher-magnitude positive torque at the take-up spindle, thereby allowing the take-up spindle to wind the tape. In effect, both spindles attempt to wind the tape away from the other, but only the take-up spindle will actually gather the tape owing to its greater torque. This scheme has been found to work admirably well in eliminating tape slack.

Third, both spindles can be driven simultaneously by providing only a single motor 96, and using gears, belts, or other power transmission means to transmit torque to both pinions 104 simultaneously. As an example, the pinions may be geared together at a ratio such that the take-up spindle rotates faster than the supply spindle and thereby takes up any slack provided by a larger-diameter tape roll on the supply spindle. When both pinions 104 are simultaneously driven in this manner, slip means should be utilized to compensate for excess tension in the tape between the spindles, as will occur when the amount of tape on the take-up spindle exceeds the amount on the supply spindle. The combination of the gearing and the slip means will act as a passive tensioning means for maintaining tension on the tape, since the slip means will account for any undue tension on the spindle containing lesser amounts of tape.

It is understood that the spindle body 22 of either or both of the first and second spindles 12 and 14 may be sized differently from those shown in the Figures. It may be advantageous to provide differently-sized supply spindles with the tape winder 10 so that tape rolls 200 having differently-sized axial bores may be accommodated. Additionally, by providing supply and take-up spindles having spindle bodies 22 with differently-sized diameters, a user may wind tape from a "standard" supply spindle onto a take-up spindle having a smaller or larger axial bore. This allows the user to easily differentiate tape rolls that have been reviewed from those that have not, since reviewed tape rolls will have axial bores which are larger or smaller than the diameter of the "standard" supply spindle.

It is understood that there are numerous structural and functional equivalents for achieving the advantages of the pocket regions 110 noted above. In the foregoing discussion, it was noted that each pocket region 110 can be provided with a narrower throat region 112 so that the axles 24 of each spindle 12 and 14 may be removably fit therein. While FIGS. 2 and 3 illustrate pocket regions 110 and throat regions 112 which are integrally formed adjacent one another on each sidewall, the same advantages can be provided by different structures using the same principles. As an example, the throat region 112 may be provided by separate structures providing for solid or resiliently flexible lands on either or both sides of the slot 106 adjacent the pocket regions 110.

Figure 4:
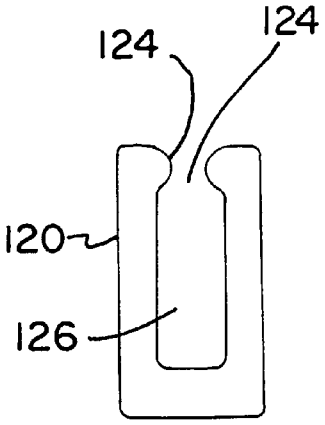
FIG. 4 is an elevated view of a key wherein the axle of a spindle may be inserted.

FIG. 4 illustrates a resiliently flexible U-shaped key 120 intended for mounting to each sidewall adjacent the pocket region 110 to thereby provide a throat region 112. The axle of the spindle can be inserted within the mouth 122 of the key 120, fit through the tabs 124, and into the pocket region 126 of the key 120.

It is understood that while the description above illustrates a throat region 112 associated with every slot 92, these throat regions 112 need not be provided in every (or any) slot 92. However, throat regions 112 are preferably located in slots 92 situated adjacent the drive means so that spindles inserted within these slots will resist ejection when the drive means are actuated.

It is understood that other control means apart from the slide switch 116 may be provided. A wide variety of other controls could be used to provide the same functions as those described above, or to provide functions which result in winding either or both spindles in either or both of a clockwise or counterclockwise direction. For example, a rotary knob could be actuated to provide the same functions as the slide switch 116. However, variable speed control and multidirectional operation is not necessary to the practice of the invention.

It is also understood that the platform 64 may include structure for enhancing the readability of tape riding on the platform 64. As examples, the platform 64 may include structures such as a needle, a shroud with a window therein, or a transparent window with a magnifying region. The tape may then ride beneath the structure, and the structure will draw the user's attention to a particular area on the tape. The platform 64 may also include lighting within the enclosure 90 which backlights the tape riding across the platform 64. The lighting may be specially chosen to emit light at wave lengths which make printing on the tape most visible.

Finally, it is to be remembered that the description set out above is of a preferred embodiment of the invention, and the words used to describe this preferred embodiment are used for the purposes of description and not limitation. For example, while the sidewalls 66 and 70 are described above as preferably being formed as a "sidewall unit" 82 and the sidewalls 68 and 72 are described above as preferably being formed as a "sidewall unit" 84, these sidewalls need not in fact be formed as units and may instead be formed separately. Thus, it is understood that the invention is not confined to the particular construction of parts and uses described above, and that it additionally includes modified embodiments that come within the scope of the following claims. Further, it is understood that in these claims, means plus function clauses are intended to cover the particular structures described in this disclosure which perform their stated function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. A tape winder comprising:

a. a housing including two pairs of opposing sidewalls, each sidewall including an upper surface and a slot descending from the upper surface and terminating in a pocket region, wherein at least one slot includes a throat region adjacent the upper surface, the throat region being generally narrower than the pocket region, whereby the spindle axis of at least one spindle may be closely fit through the throat region to rest within the pocket region;

b. first and second spindles, each spindle having a spindle axle sized for removable insertion into the slots on one pair of opposing sidewalls, whereby the spindle axle may be rotatably mounted in the pocket region of that pair of sidewalls; and c. drive means for releasibly engaging and rotatably driving at least one spindle, the drive means being located on at least one sidewall adjacent the pocket region on that sidewall.

2. The tape winder of claim 1 further comprising:

a. a roll of tape wrapped about each of the first and second spindles and extending between the first and second spindles, one of the first and second spindles defining a supply spindle and the other spindle defining a take-up spindle, wherein the take-up spindle takes up tape supplied from the supply spindle;

b. tensioning means on the supply spindle for maintaining tension on the tape.

3. The tape winder of claim 1 in combination with at least one additional spindle having a spindle axle sized for removable insertion into the slots on one pair of opposing sidewalls, each additional spindle having a diameter which is differently sized than the first and second spindles.

4. The tape winder of claim 1 wherein at least one of the first and second spindles includes a corrugated region thereon, and further including a disk with a bore therein, the wall of the bore including locking means for releasibly engaging the corrugated region.

5. A tape winder comprising:

a. a housing including two pairs of opposing sidewalls, each sidewall including an upper surface and a slot descending from the upper surface and terminating in a pocket region;

b. first and second spindles, each spindle having a spindle axle sized for removable insertion into the slots on one pair of opposing sidewalls, whereby the spindle axle may be rotatably mounted in the pocket region of that pair of sidewalls; and c. a roll of tape wrapped about each of the first and second spindles and extending between the first and second spindles, one of the first and second spindles defining a supply spindle and the other spindle defining a take-up spindle, wherein the take-up spindle takes up tape supplied from the supply spindle;

d. tensioning means on the supply spindle for maintaining tension on the tape;

e. drive means for releasibly engaging and rotatably driving at least one spindle, the drive means being located on at least one sidewall adjacent the pocket region on that sidewall;

wherein the tensioning means comprises the drive means simultaneously driving both of the take-up and supply spindles, and wherein the supply spindle is driven with lesser torque than the take-up spindle.

6. The tape winder of claim 5 wherein the supply spindle is driven with negative torque.

7. A tape winder comprising:

a. a housing including two pairs of opposing sidewalls, each sidewall including an upper surface and a slot descending from the upper surface and terminating in a pocket region;

b. first and second spindles, each spindle having a spindle axle sized for removable insertion into the slots on one pair of opposing sidewalls, whereby the spindle axle may be rotatably mounted in the pocket region of that pair of sidewalls;

c. drive means for releasibly engaging and rotatably driving at least one spindle, the drive means being located on at least one sidewall adjacent the pocket region on that sidewall; and d. a platform located between the two pairs of opposing sidewalls, the platform including rollers at its edges adjacent each pair of opposing sidewalls.

8. A tape winder comprising:

a. a housing including two pairs of opposing sidewalls, each sidewall including an upper surface and a slot descending from the upper surface, wherein at least one slot includes a pocket region and a narrower throat region between the pocket region and the upper surface;

b. first and second spindles, each spindle having a spindle axle sized for removable insertion into the slots on one pair of opposing sidewalls, whereby the axle may be rotatably mounted in the pocket region of that pair of opposing sidewalls.

9. The tape winder of claim 8 wherein the throat region is integrally formed on the surface of the slot.

10. The tape winder of claim 8 further comprising:

a. a roll of tape wrapped about each of the first and second spindles and extending between the first and second spindles, one of the first and second spindles defining a supply spindle and the other spindle defining a take-up spindle, wherein the take-up spindle takes up tape supplied from the supply spindle;

b. tensioning means on the supply spindle for maintaining tension on the tape.

11. The tape winder of claim 10 wherein the tensioning means simultaneously drives both of the take-up and supply spindles, wherein the supply spindle is driven with lesser torque than the take-up spindle.

12. The tape winder of claim 11 wherein the supply spindle is driven with negative torque with respect to the take-up spindle.

13. The tape winder of claim 10 further comprising a platform located between the two pairs of opposing sidewalls, the platform including rollers at its edges adjacent each pair of opposing sidewalls.

14. The tape winder of claim 8 wherein at least one slot includes the throat region adjacent the upper surface, the throat region being generally narrower than the pocket region, whereby the spindle axle of at least one spindle may be closely fit through the throat region to rest within the pocket region.

15. A tape winder comprising:

a. a rotatable supply spindle;

b. a rotatable take-up spindle spaced from the supply spindle;

c. a roll of tape wrapped about each of the supply and take-up spindles and extending between the supply and take-up spindles, whereby the take-up spindle may rotate to take tape from the supply spindle;

d. first drive means for rotatably driving the take-up spindle;

e. tensioning means connected to the supply spindle for maintaining tension on the tape, wherein the tensioning means comprises the first drive means simultaneously driving both of the take-up and supply spindles, and wherein the supply spindle is driven with lesser torque than the take-up spindle.

16. The tape winder of claim 15 wherein the supply spindle is driven with negative torque with respect to the take-up spindle.

17. The tape winder of claim 15 wherein the tensioning means comprises a belt interposed between the first drive means and the spindle axle of the supply spindle.

* * * * *